United States Patent [19]

Kruper

[11] 4,187,166

[45] Feb. 5, 1980

[54] METHOD OF REMOVING COPPER IONS FROM A BATH CONTAINING SAME

[75] Inventor: Wayne A. Kruper, Willowick, Ohio

[73] Assignee: Gould Inc., Rolling Meadows, Ill.

[21] Appl. No.: 5,602

[22] Filed: Jan. 22, 1979

[51] Int. Cl.[2] ..... C25C 1/12

[52] U.S. Cl. ..... 204/43 S; 204/44; 204/148

[58] Field of Search ..... 204/149, 43 S, 44, 148; 423/24

[56] References Cited

U.S. PATENT DOCUMENTS

| | | | |
|---|---|---|---|
| 3,812,020 | 5/1974 | Vander Mey | 204/43 S X |
| 3,940,319 | 2/1976 | Pollack | 204/43 S |

*Primary Examiner*—Arthur C. Prescott

*Attorney, Agent, or Firm*—Russell E. Baumann; Edward E. Sachs

[57] ABSTRACT

A process is provided for electrodepositing a covering layer of lead-tin on the surface of a bearing structure formed by co-electrodepositing lead, copper and tin which process comprises providing a metallic substrate; placing said metallic substrate in an electroplating bath containing lead ions, tin ions and copper ions; passing electrical current through said bath to deposit a layer of lead-tin-copper on the surface of said substrate; removing said so-plated substrate from said bath; subjecting said so-plated substrate to an aqueous rinsing media to remove electrolyte drag-out from said plating bath from the said plated substrate; bring said aqueous rinse media into contact with a metal selected from the group consisting of lead, tin and alloys thereof for a period of time sufficient to cause copper ions in said media to be replaced by ions of said metal and said copper ions to deposit as copper metal on the remainder of said metal; placing said rinsed substrate in an electroplating bath which is essentially devoid of copper ion and which contains both lead ions and tin ions; and passing electrical current through said electroplating bath to deposit a layer of lead-tin on the surface of said substrate.

8 Claims, No Drawings

METHOD OF REMOVING COPPER IONS FROM A BATH CONTAINING SAME

BACKGROUND OF THE INVENTION (a) Field of the Invention

The present invention relates to an improved method for producing a bearing structure. More particularly, it concerns a method by which a bearing layer of lead-tin-copper can be electrolytically overplated with a protective layer of tin-lead alloy while minimizing waste treatment problems associated with conventional techniques for producing such an article.

(b) Description of Prior Art

It is well known in the art to produce a bearing structure or article by electrodepositing a layer of tin-lead-copper alloy on at least part of the surface of a given metallic substrate. Likewise, it is well known in the art to overplate this layer of tin-lead-copper alloy with a covering layer of lead-tin alloy to both enhance the appearance of the bearing structure and to improve its corrosion resistance.

Conventionally, in the manufacture of a bearing structure, lead-tin-copper electrodeposits are obtained by placing a suitable substrate in an electroplating bath which contains lead, tin and copper ions and then passing electric current through the bath. The so-plated substrate is then subjected to an aqueous rinse treatment to remove plating bath drag-out therefrom before it is over-plated with a protective layer of lead-tin alloy. The resultant rinse material (water) is then treated by conventional waste treatment systems such as evaporation to remove the recovery contaminates therefrom.

The evaporation recovery equipment utilized to treat the rinse water is both expensive to build and to operate. Obviously, it would be desirable to have a technique for manufacturing such bearing articles which is free from such pollution problems and does not require the use of such expensive evaporation recovery equipment.

Accordingly, it is the principal object of the present invention to provide a novel electrolytic technique for producing lead-tin-copper bearing structures which are overplated with a protective layer of lead-tin while minimizing the pollution problems associated therewith.

SUMMARY OF THE INVENTION

In one aspect, the present invention concerns a process for removing copper ions from an aqueous bath containing lead ions, copper ions and tin ions which process comprises bringing said baths into contact with a metal selected from the group consisting of lead, tin and alloys thereof for a period of time sufficient to cause copper ions present in said bath to be removed from said bath by a substitution reaction with said substitution metal selected from the group consisting of lead, tin and alloys thereof.

In another aspect, the invention concerns a process for electrodepositing a covering layer of lead-tin on the surface of a bearing structure formed by co-electrodepositing lead, copper and tin which process comprises providing a metallic substrate; placing said metallic substrate in an electroplating bath containing lead ions, tin ions and copper ions; passing electrical current through said bath to deposit a layer of lead-tin-copper on the surface of said substrate; removing said so-plated substrate from said bath; subjecting said so-plated substrate to an aqueous rinsing media to remove electrolytic drag-out from said plating bath from the said plated substrate; bringing said aqueous rinse media into contact with a substitution metal selected from the group consisting of lead, tin and alloys thereof for a period of time sufficient to cause copper ions in said media to be replaced by ions of said metal and said copper ions to deposit as copper metal on the remainder of said metal; placing said rinsed substrate in an electroplating bath which is essentially devoid of copper ions and which contains both lead ions and tin ions; and passing electrical current through said electroplating bath to deposit a layer of lead-tin on the surface of said substrate.

BRIEF DESCRIPTION OF THE PREFERRED EMBODIMENTS OF THE INVENTION

The present invention will now be described in greater detail with references to the following examples which are presented here for illustrative purposes only and not for the purpose of limiting the scope of the invention instant.

EXAMPLE I

A plating bath for the electrodepositing of a lead-tin-copper alloy bearing layer was prepared which contained 90 g/l of lead (as fluoborate), 7.2 g/l of tin (as fluoborate), 40 g/l of fluoborate acid, 30 g/l of boric acid and 1.9 g/l of copper (as fluoborate). Twenty-Five liters of the bath were circulated through 20 pounds of chopped lead sheet. The copper content of the bath at commencement of circulation was 1.9000 g/l. After one hour of circulating the bath through the chopped lead sheet the copper content of the bath was 0.0839 g/l. After two hours the copper content was 0.0022 g/l. After three hours the copper content was 0.0012 g/l. After four hours the copper content was 0.0001 g/l.

From the foregoing it is clear that a substrate coated with a layer of lead-tin-copper alloy could be removed from the so-treated plating bath and placed into a plating bath consisting of lead and tin ions without fear of draging copper ions from the first (lead-tin-copper) plating bath into the second (lead-tin) plating bath to cause it to become contaminated with significant amounts of undesirable copper ions. Additionally, the second bath is not diluted with water and therefore chemicals need not be added to maintain concentration.

EXAMPLE II

A conventional bath for the electrodeposition of a bearing layer consisting of a lead-tin-copper alloy is prepared which contains suitable amounts of lead ions, tin ions and copper ions. The substrate to be coated with the bearing layer of lead-tin-copper alloy is placed in the electroplating bath and in a conventional manner electric current is passed therethrough. After deposition of the lead-tin-copper alloy layer, the so-called substrate is removed from the plating bath and subjected to a rinsing treatment. The rinse water, which now contains lead, tin and copper ions due to drag-out from the original plating bath, is brought into contact with a metal selected from the group consisting of lead, tin and alloys thereof for a period of time sufficient to remove the major portion of the copper ions therefrom by a substitution reaction with the lead, tin or lead-tin alloy, as the case may be, while the copper ions deposit as copper metal on the remaining lead, tin or lead-tin alloy. This treated rinse water can then be recirculated. The so-plated substrate is then placed in an electroplating bath containing lead and tin ions (no significant amount of copper ions being present) and electric current is passed therethrough to deposit an overlay of a lead-tin alloy on the surface of the lead-tin-copper alloy bearing layer. The surface layer of tin-lead is free from copper.

EXAMPLE III

The technique described in Example II is repeated except the rinse water is treated to remove copper ions therefrom in such a fashion that lead and tin ions are present in an amount sufficient to permit the rinse water to be used as the electroplating bath for the deposition of the lead-tin alloy overlay.

From the foregoing, it is clear that the crux of the invention is treating the rinse solution or media (water) to remove undesirable copper ions therefrom by bringing the water into contact with a metal selected from the group consisting of lead, tin and alloys thereof for a period of time sufficient to cause the copper ions to be removed therefrom by a replacement or substitution reaction with the lead, tin or lead-tin alloy material.

Accordingly, the specific equipment utilized in the practice of the invention is not critical. The method of the invention can be carried out in a self-contained automated unit or by employing a series of individual plating and rinse baths. All that is required is that apparatus be utilized which can accomplish the invention as described and claimed herein.

In practice, it may be desirable to remove copper ions from each bath or only remove it from the last one, i.e. the one employed immediately preceding placing the article being plated into the lead-tin electroplating bath. In addition, as hereinbefore mentioned, it may be desirable to treat the rinse water to remove copper ions therefor and then employ the resultant solution as either the lead-tin electroplating bath proper or as make up for such a bath.

The metal used to remove copper from the bath is either lead, tin or an alloy thereof. It can take any convenient form. It can be in the shape of beads, pellets, rods, saddles, wire mesh, screen, etc.

It will be appreciated by those skilled in that the present invention only requires that the tin-lead plating bath be free from copper to the extent that any copper present does not adversely affect the final surface coating of lead-tin by causing it to become darkened or discolored when subsequently exposed to the ambient atmosphere. That is, trace amounts of copper can be tolerated but amounts which will cause surface discoloration are to be avoided.

Finally, it will also be understood that the embodiments of the present invention which have been described are merely illustrative of a few of the applications of the principles of the invention. Numerous modifications may be made by those skilled in the art without departing from the true spirit and scope of the invention.

The invention claimed is:

1. A process for electrodepositing a covering layer of lead-tin on the surface of a bearing structure formed by co-electrodepositing lead, copper and tin which process comprises providing a metallic substrate;

placing said metallic substrate in an electroplating bath containing lead ions, tin ions and copper ions, passing electrical current through said bath to deposit a layer of lead-tin-copper on the surface of said substrate;

removing said so-plated substrate from said bath;

subjecting said so-plated substrate to an aqueous rinsing media to remove electrolyte drag-out from said plating bath from the said plated substrate;

bring said aqueous rinse media into contact with a metal selected from the group consisting of lead, tin and alloys thereof for a period of time sufficient to cause copper ions in said media to be replaced by ions of said metal and said copper ions to deposit on the remained of said metal;

placing said rinsed plated substrate in an electroplating bath which is essentially devoid of copper ions and which contain both lead ions and tin ions; and passing electrical current through said electroplating bath to deposit a layer of lead-tin on the surface of said substrate.

2. The method of claim 1 wherein said plated substrate is subjected to a plurality of rinsing treatments.

3. The method of claim 1 wherein said aqueous rinsing media is treated by bringing it into contact with a metal selected from the group consisting of lead, tin and alloys thereof for a period of time sufficient to remove copper ions therefrom and then used as the electroplating bath for depositing a layer of lead-tin on the surface of the lead-tin-copper bearing layers.

4. A process for removing copper ions from an aqueous bath containing lead ions, copper ions and tin ions which process comprises bringing said bath into contact with a metal selected from the group consisting of lead, tin and alloys thereof for a period of time sufficient to cause copper ions present in said bath to be removed from said bath by a substitution reaction with said metal selected from the group consisting of lead, tin and alloys thereof.

5. In a process for electrodepositing a covering layer of lead-tin on the surface of a bearing structure formed by co-electrodepositing lead, copper and tin on a metallic substrate which process comprises providing a metallic substrate; placing said metallic substrate in an electroplating bath containing lead ions, tin ions and copper ions; passing electrical current through said bath to deposit a layer of lead-tin-copper on the surface of said substrate; removing said so-plated substrate from said bath; subjecting said so-plated substrate to an aqueous rinsing media to remove electrolyte drag-out from said plating bath from the said plated substrate; placing said rinsed plated substrate in an electroplating bath which is essentially devoid of copper ion and which contains both lead ions and tin ions; and passing electrical current through said electroplating bath to deposit a layer of lead-tin on the surface of said substrate; the improvement which comprises: bringing said aqueous rinse media into contact with a metal selected from the group consisting of lead, tin and alloys thereof for a period of time sufficient to cause copper ions in said media to be replaced by ions of said metal and said copper ions to deposit on the remained of said metal before said substrate is removed therefrom.

6. The method of claim 5 wherein said plated substrate is subjected to a plurality of rinsing treatments.

7. The method of claim 5 wherein said aqueous rinsing media is treated by bringing it into contact with a metal selected from the group consisting of lead, tin and alloys thereof for a period of time sufficient to remove copper ions therefrom and then used as the electroplating bath for depositing a layer of lead-tin.

8. The method of removing copper ions from a solution containing the same as herein described.

* * * * *